US010130980B2

(12) United States Patent
Duhoux et al.

(10) Patent No.: US 10,130,980 B2
(45) Date of Patent: Nov. 20, 2018

(54) COOLING FACILITY AND METHOD

(71) Applicant: CONSTELLIUM NEUF-BRISACH, Biesheim (FR)

(72) Inventors: Vincent Duhoux, Coublevie (FR); Bruno Magnin, Saint-Aupre (FR); Daniel Bellot, Izeaux (FR); Jose Roche, Bowling Green, KY (US); Pierre Aucouturier, Sundhoffen (FR)

(73) Assignee: CONSTELLIUM NEUF-BRISACH, Biesheim (FR)

( * ) Notice: Subject to any disclaimer, the term of this patent is extended or adjusted under 35 U.S.C. 154(b) by 85 days.

(21) Appl. No.: 15/326,753

(22) PCT Filed: Jul. 10, 2015

(86) PCT No.: PCT/FR2015/051915
§ 371 (c)(1),
(2) Date: Jan. 17, 2017

(87) PCT Pub. No.: WO2016/012691
PCT Pub. Date: Jan. 28, 2016

(65) Prior Publication Data

US 2017/0189949 A1 Jul. 6, 2017

(30) Foreign Application Priority Data

Jul. 23, 2014 (FR) ..... 14 01679

(51) Int. Cl.
*B21B 37/74* (2006.01)
*B21B 45/00* (2006.01)
(Continued)

(52) U.S. Cl.
CPC ..... *B21B 37/74* (2013.01); *B21B 45/004* (2013.01); *B21B 45/0218* (2013.01);
(Continued)

(58) Field of Classification Search
CPC ..... B21B 37/74
See application file for complete search history.

(56) References Cited

U.S. PATENT DOCUMENTS 5,112,412 A * 5/1992 Plata ..... C21D 1/667 134/15

FOREIGN PATENT DOCUMENTS

CN 1731132 A 2/2006
DE 19823790 A1 12/1999
(Continued)

OTHER PUBLICATIONS

Sheet Ingots. Apr. 20, 2012, www.hydro.com/en/products/casthouse-products/Sheet-ingots/. Accessed Sep. 6, 2017.*
(Continued)

*Primary Examiner* — Jessee R Roe
*Assistant Examiner* — Jophy S. Koshy
(74) *Attorney, Agent, or Firm* — McBee Moore Woodward & Vanik IP, LLC; Susan McBee; David Vanik

(57) ABSTRACT

A cooling method for a rolling ingot of aluminum alloy after metallurgical homogenization heat treatment of said ingot and before hot rolling, characterized in that cooling by 30 to 150° C. is performed at a rate of 150 to 500° C./h, with a thermal differential of less than 40° C. throughout the treated portion of the ingot is disclosed. A facility allowing use of said method and said implementation is also disclosed.

12 Claims, 10 Drawing Sheets

(51) Int. Cl.

| | |
|---|---|
| ***B21B 45/02*** | (2006.01) |
| ***C21D 11/00*** | (2006.01) |
| ***C22F 1/04*** | (2006.01) |
| ***C21D 1/667*** | (2006.01) |
| ***C22F 1/00*** | (2006.01) |
| *B21B 1/22* | (2006.01) |
| *B21B 3/00* | (2006.01) |

(52) U.S. Cl.

CPC ..... *C21D 1/667* (2013.01); *C21D 11/005* (2013.01); *C22F 1/002* (2013.01); *C22F 1/04* (2013.01); *B21B 2001/225* (2013.01); *B21B 2003/001* (2013.01); *B21B 2045/0212* (2013.01); *B21B 2261/04* (2013.01); *B21B 2261/06* (2013.01); *B21B 2261/12* (2013.01); *B21B 2261/20* (2013.01)

(56) References Cited

FOREIGN PATENT DOCUMENTS

| | | | |
|---|---|---|---|
| EP | 2656932 | A1 | 10/2013 |
| JP | s60243226 | | 12/1985 |
| TW | 200920506 | A | 5/2009 |

OTHER PUBLICATIONS

International Search Report dated Oct. 27, 2015, issued in counterpart International Application No. PCT/FR2015/051915.

Taiwan Search Report completed Nov. 8, 2016, issued in counterpart Taiwan Application No. 104123584.

* cited by examiner

COOLING FACILITY AND METHOD

CROSS REFERENCE TO RELATED APPLICATIONS

This application is a § 371 National Stage Application of PCT/FR2015/051915, filed Jul. 10, 2015, which claims priority provisional application no. 1401679, filed Jul. 23, 2014.

BACKGROUND

Field of the Invention

The invention relates to the field of rolling aluminium alloy ingots or slabs.

More specifically, the invention relates to a particularly rapid, homogeneous and reproducible method for cooling the ingot between homogenization and hot rolling operations.

The invention also relates to the facility or equipment used to implement the method.

Description of Related Art

Transformation of aluminium alloy rolling ingots from casting requires metallurgical homogenization heat treatment before hot rolling. This heat treatment is carried out at a temperature near the solvus of the alloy, higher than the hot rolling temperature. The difference between the homogenization temperature and the hot rolling temperature is between 30 and 150° C. depending on the alloys. The ingot must therefore be cooled between leaving the homogenization furnace and being hot rolled. For reasons of either productivity or metallurgical structure, notably preventing certain surface defects on the finished sheet, it is highly desirable to cool the ingot quickly between leaving the homogenization furnace and the hot-rolling mill.

The desired cooling rate for the ingot is between 150 and 500° C./h.

Given the great thickness of aluminium alloy rolling ingots, which is between 250 and 800 mm, air cooling is particularly slow: the rate of air cooling for an ingot 600 mm thick is between 40° C./h in still air or with natural convection, and 100° C./h in vented air or with forced convection.

Air cooling does therefore not make it possible to achieve the desired cooling rates. Cooling by means of a liquid or spray (a mixture of air and liquid) is much faster because the value of the exchange ratio, known to experts in the field by the name HTC (Heat Transfer Coefficient) between a liquid or a spray and the hot surface of the metal ingot is significantly higher than the value of the same coefficient between air and the ingot.

The liquid chosen, alone or in a spray, is for example, water, and in this case, ideally deionized water. Therefore, the HTC coefficient is between 2000 and 20000 W/(m$^2$·K) between water and the hot ingot, while it is between 10 and 30 W/(m$^2$·K) between air and the hot ingot.

However, cooling by means of a liquid or spray usually generates naturally high thermal gradients in the ingot:

The dimensionless Biot number illustrates the thermal homogeneity of cooling. It is the ratio of the internal thermal resistance of a body (internal heat transfer by conduction) to its surface thermal resistance (heat transfer by convection and radiation).

$$Bi = \frac{HTC \cdot D}{\lambda}$$

HTC being the exchange coefficient between the fluid and the ingot,

D, the characteristic dimension of the system, here the half-thickness of the ingot, λ, the thermal conductivity of the metal, for example, for an aluminium alloy, 160 W/(m$^2$·K).

If Bi<<1, the system is practically isothermal, and cooling is uniform.

If Bi>>1, the system is thermally very heterogeneous and the ingot is the site of high thermal gradients.

For an ingot of thickness of 600 mm, the Biot number is:

Between 0.02 and 0.06 for cooling in still or ventilated air. The Biot number is small in relation to 1: the ingot is cooled isothermally.

Between 4 and 40 for water cooling. The Biot number is high in relation to 1: the ingot is cooled very heterogeneously throughout its thickness.

This heterogeneity is also reflected in the width of the ingot, due to the effects of rims and edges, which are naturally more cooled than the large surfaces of the ingot.

It is also reflected in the length of the ingot, by corner effect, naturally cooled along the three faces that make it up.

Thermal heterogeneity is a major handicap for cooling using a liquid or a spray. It is a problem not only for the following method, i.e. hot rolling but it is also potentially detrimental to the quality of the final product, namely aluminium alloy sold in coils or plates with high mechanical properties.

Systems known from prior art do not seek to limit the heterogeneity of cooling. Cooling methods using a cooling liquid known from prior art, especially for heavy sheets, operate either by immersion in a tank, or by passing through a spray box but without any particular attention paid to controlling the heat balance of the product. So these methods:

do not make it possible to obtain a uniform thermal field in the cooled ingot cannot guarantee the reproducibility of the cooling from one ingot to another.

SUMMARY

The invention aims to correct all of the major defects related to cooling processes for thick ingots from prior art and to ensure:

Rapid cooling, at a rate of at least 150° C./h, and by a significant amount, i.e. 30 to 150° C. cooling from a temperature of the order of 450 to 600° C.

A homogeneous and controlled thermal field across the ingot

The assurance of perfect reproducibility from one thick ingot to another.

Subject of the Invention

The invention relates to a cooling method for a typical aluminium alloy rolling ingot of dimensions 250 to 800 mm in thickness, from 1000 to 2000 mm in width and 2000 to 8000 mm in length after metallurgical homogenization heat treatment of said ingot at a temperature typically between 450 to 600° C. depending on the alloys and prior to hot rolling, characterized in that the cooling, by a value of 30 to 150° C., is performed at a rate of from 150 to 500° C./h, with a thermal differential of less than 40° C. over the entire ingot cooled from its homogenization temperature.

Thermal differential is taken to mean the maximum difference between temperature readings taken throughout the volume of the ingot, or DTmax.

Advantageously, cooling is carried out in at least two phases:

A first spraying phrase in which the ingot is cooled in a chamber comprising ramps of nozzles or tuyers for spraying cooling liquid or spray under pressure, divided into upper and lower parts of said cell, so as to spray the two large top and bottom surfaces of said ingot, A complementary phase of thermal equalization in still air, in a tunnel with interior reflective walls, lasting from 2 to 30 minutes depending on the ingot format and the cooling value.

Typically, this time is approximately 30 min for total cooling of the order of 150° C. to from substantially 500° C. and a few minutes for cooling by about 30° C.

According to a variant of the invention, the spraying and thermal equalization phases are repeated in the case of very thick ingots and for an overall average cooling of more than 80° C.

Most commonly, the coolant, including that in a spray, is water, and preferably deionized water.

According to a particular embodiment, the head and the foot of the ingot, or typically the 300 to 600 mm at the ends, are less cooled than the rest of the ingot, so as to maintain a hot head and foot, a favourable configuration for engaging the ingot during reversible hot rolling.

To this end, the cooling of the head and foot may be modulated either by turning the ramps of spray nozzles or tuyers on or off, or by the use of screens preventing or reducing spraying by said spray nozzles. Furthermore, the spraying phases, and not thermal equalization, can be repeated, and the head and foot of the ingot, or typically the 300 to 600 mm at the ends, cooled differently from the rest of the ingot in at least one of the spray chambers.

According to a version that complies with the latter option, the first spray pass is performed with zero heel, or continuous spraying of the ingot such as is shown in FIG. 14, followed, without a first thermal equalization phase, by a second spray pass with a heel of a pair of ramps such as is shown in FIG. 12, thereby making it possible to significantly reduce the duration of the final equalization phase necessary for thermal balancing of the ingot.

In a preferred variant of the invention, the longitudinal thermal uniformity of the ingot is improved by relative movement of the ingot in relation to the spray system: the ingot passes or moves with a reciprocating movement facing a fixed spray system or vice versa, nozzles or spray nozzles moving relative to the ingot.

Typically, the ingot moves horizontally in the spray chamber and its speed is greater than or equal to 20 mm/s, or 1.2 m/min.

Also preferably, the transverse thermal uniformity of the ingot is ensured by modulating spraying in the ingot width by switching of the nozzles or tuyers on or off, or screening said spraying.

The invention also relates to a facility for using the method as above, comprising a spray chamber provided with ramps of nozzles or tuyers for spraying cooling liquid or spray under pressure, arranged in the upper and lower parts of said cell, so as to spray the two large top and bottom surfaces of said ingot, An equalization tunnel in still air on leaving the spray chamber, in a tunnel whose internal walls and roof are made of an internally reflective material, allowing equalization of the ingot by heat diffusion in said ingot, the core warming the surfaces. According to a preferred embodiment:

The cooling liquid or spray nozzles produce full cone sprays or jets with an angle of between 45 and 60°

The lower nozzle axes are oriented normally to the lower surface.

Preferably, the upper nozzle ramps are paired in the direction of movement of the ingot. In any given pair, the upper ramps are inclined such that:

- The jets of the two paired upper nozzle ramps are oriented in opposition to one another
- The jets have a normal edge to the upper surface of the ingot
- The overlap of two jets is between ⅓ and ⅔ of the width of each jet, and preferably substantially half
- The envelope of the two jets so formed has an M profile.

The pairs of upper and lower nozzle ramps are placed substantially face-to-face, so that the upper and lower spray lengths are substantially equal and opposite each other.

Because of the pairing of the upper nozzles in opposition and the M profile of the jets, the spray length is controlled to promote lateral discharge of the liquid or spray sprayed on the upper surface, guiding it to the ingot edges where it is discharged in the form of a cascade without touching the ingot small surfaces thereby permitting uniform cooling in the longitudinal and transverse directions of the ingot.

As for the liquid, whether alone or in the cooling spray, this can be recovered, typically in a container located under the facility, recycled and thermally controlled.

In an improved means of implementation, the entire facility, spray chamber and equalization tunnel is controlled by a thermal model encoded on a programmable logic controller (PLC), the thermal model determining the settings of the facility according to the temperature estimated by thermal measurement at the start of the spray chamber and according to the target output temperature, typically the start temperature for hot rolling.

According to an advantageous embodiment, operation of the facility comprises the following steps:

- Centring the ingot, at the entrance to the facility
- Measuring the upper surface temperature of the ingot
- Calculation by the PLC, using the thermal model, of the spray chamber settings depending on the target input temperature and the target output temperature, i.e. target cooling of the ingot, including determining the number of ramps activated, the number of nozzles open at the ingot edges, speed of movement of the ingot within the spray chamber, starting and stopping the spraying ramps, and the holding time in the equalization tunnel
- Moving the ingot continuously through the spray chamber, with upper and lower spraying according to the PLC calculations
- Transfer of the ingot from the spray chamber to the equalization tunnel
- Holding the ingot in the equalization tunnel for a period determined by the PLC.

Multi-pass cooling can also be performed with a single machine, by means of successive passages.

Figure 3:
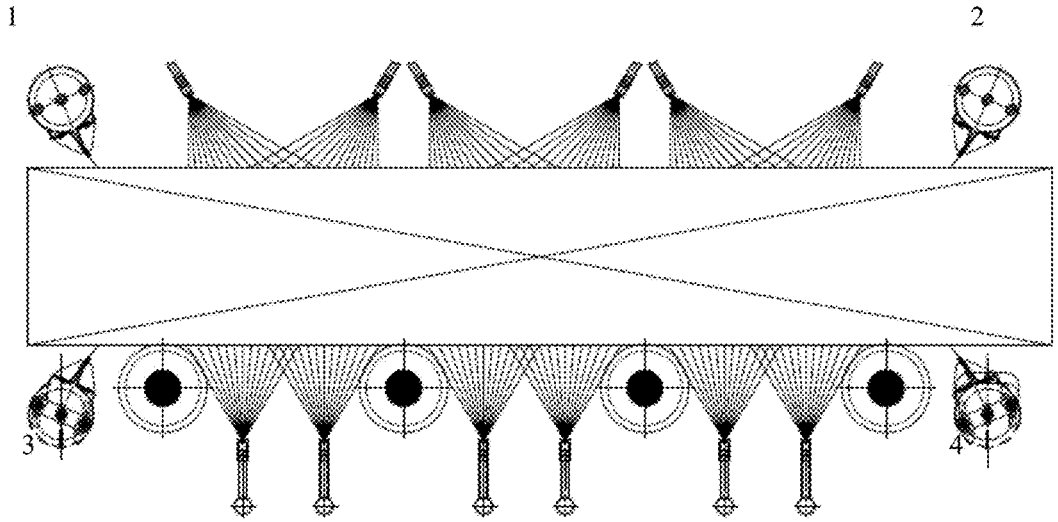

FIG. 3 is a schematic side view drawing of the spray machine, the ingot running from left to right. It illustrates the arrangement of the jets of liquid or spray sprayed on the ingot, seen from the side, on the upper side and the lower side. The upper and lower spray ramps are paired and opposite each other in pairs, to ensure proper cooling uniformity in the thickness of the ingot. The paired upper ramps are oppositely directed, which ensures that the liquid or mist sprayed will be discharged transversely to the ingot. The lower nozzle axes are oriented normally to the lower surface of the ingot, the liquid running off by gravity. Compressed air ramps (1-4) frame the ends of the spray chamber to prevent any residual liquid runoff onto the ingot outside said cell.

Figure 4:
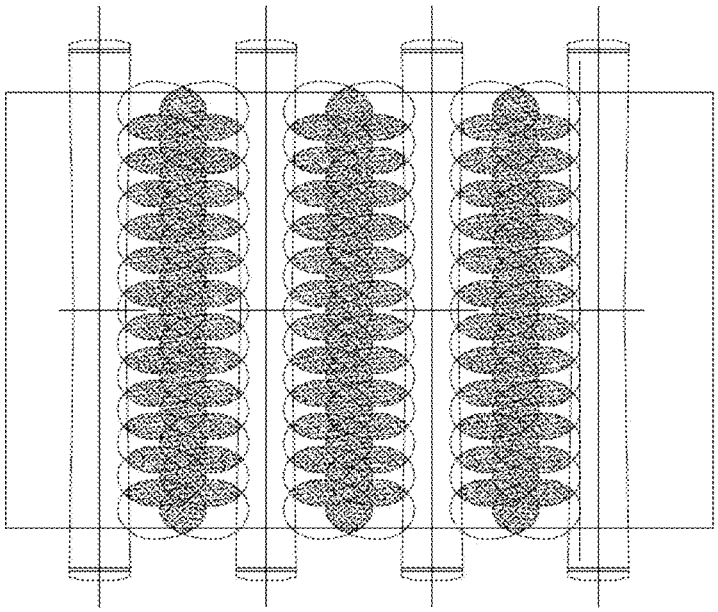

FIG. 4 illustrates the effect of upper jets of liquid or spray, seen from above the ingot. The concentration of the surface flow rate of liquid or spray will be noted at the intersection of opposing jets. This spraying layout helps removal of the liquid along this transverse line with a high surface flow rate.

Figure 5:
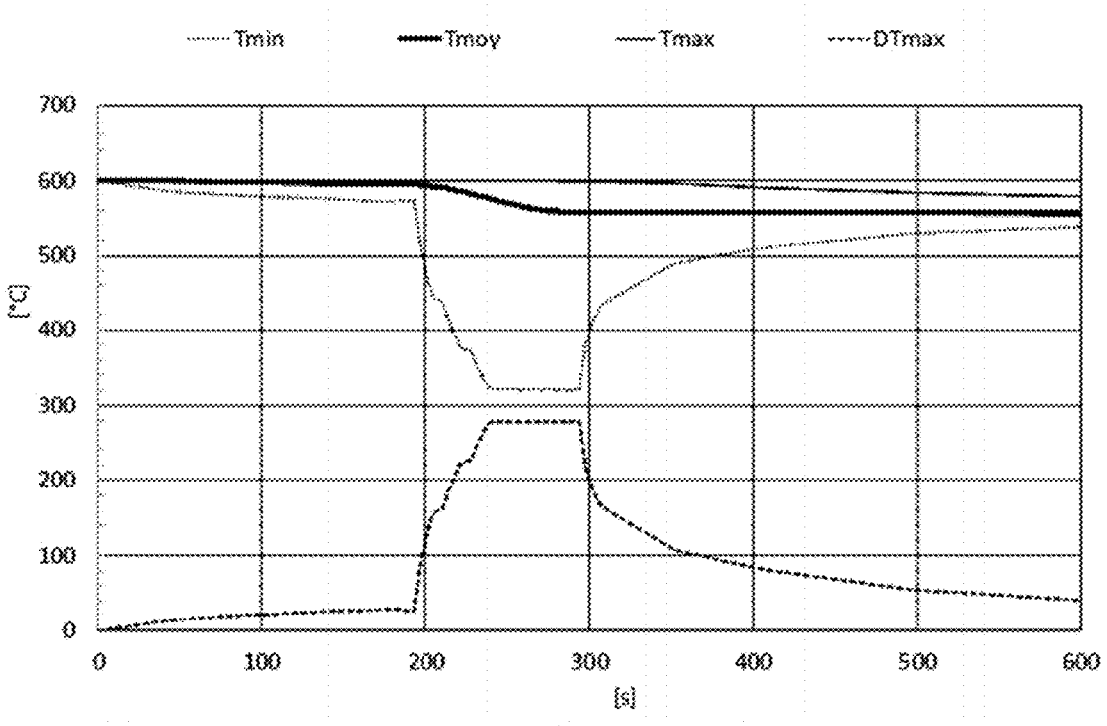

FIG. 5 shows the thermal kinetics of a 600 mm ingot, calculated for average cooling of 40° C., in one pass in the spray machine, for an AA3104 type alloy according to designations defined by the "Aluminum Association" in the "Registration Record Series" that it publishes regularly. This shows changes in minimum Tmin, maximum Tmax and average Tmoy temperatures in the ingot, and the maximum temperature differential throughout the whole volume of the ingot, over time (DT max).

Figure 6:
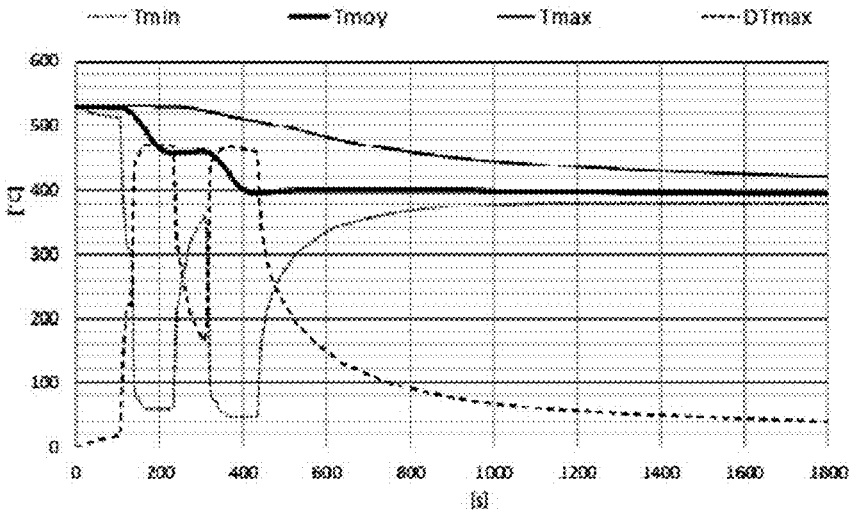

FIG. 6 shows the thermal kinetics of a 600 mm ingot, calculated for average cooling of 130° C., in two passes in the spray machine, for an AA6016 type alloy according to designations defined by the "Aluminum Association" in the "Registration Record Series" that it publishes regularly. This shows, in the same way changes in minimum Tmin, maximum Tmax and average Tmoy temperatures in the ingot, and the maximum temperature differential throughout the whole volume of the ingot, over time (DT max).

Figure 7:
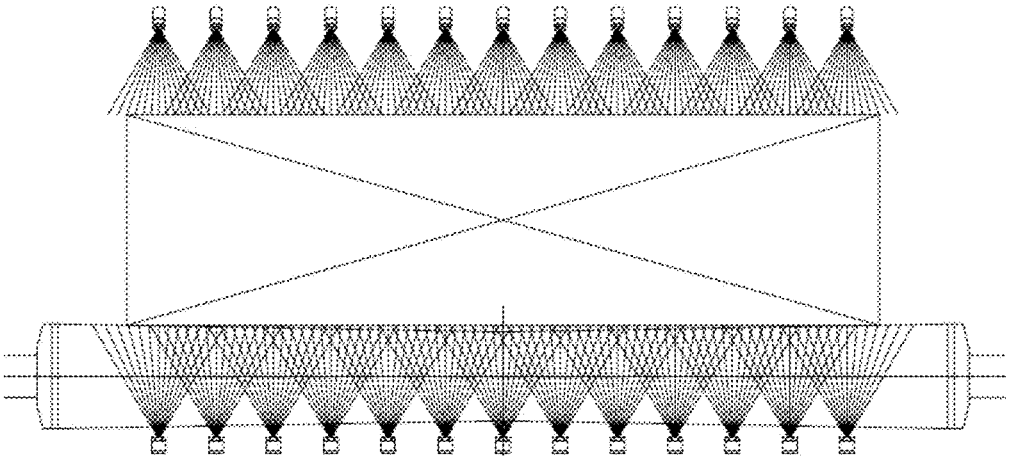
Figure 8:
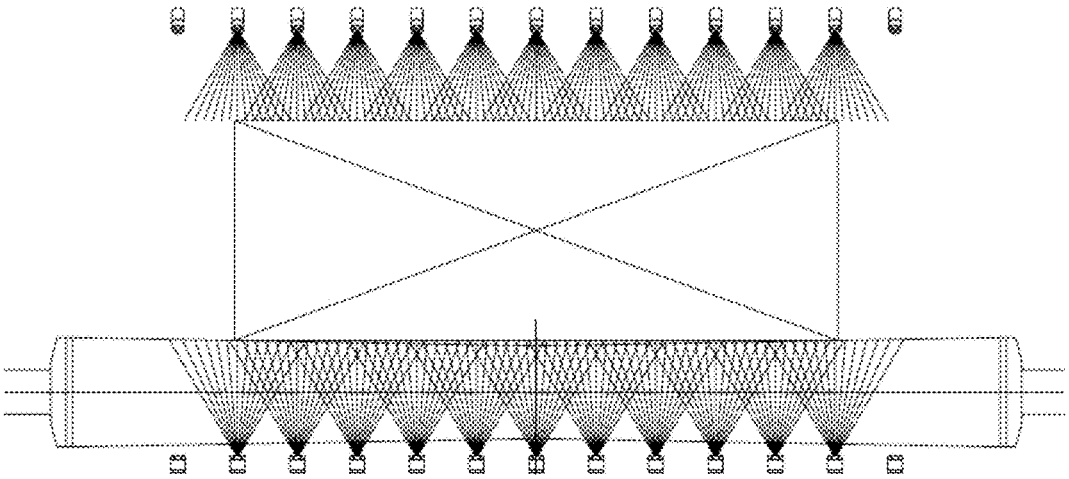
Figure 9:
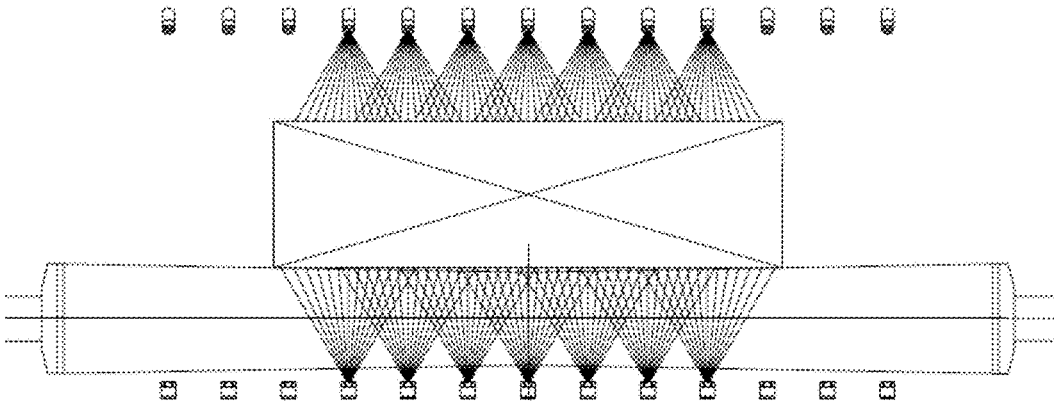

FIGS. 7 to 9 illustrate three spraying modes or strategies transverse to the spray machine showing the position of the nozzles on the spray ramps, the spraying machine being shown from the front in all cases:

FIG. 7: Uniform temperature profile in the width of the ingot

Figure 10:
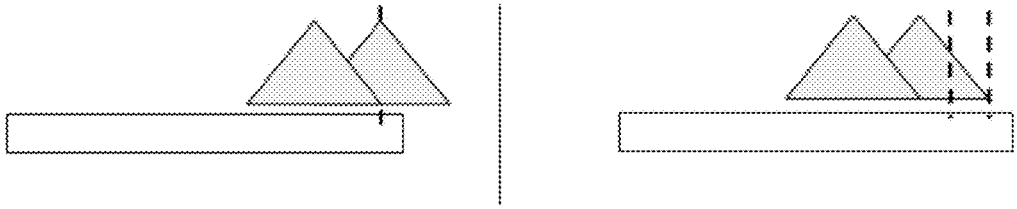

FIG. 8: Temperature profile with cold ingot edges, created by surplus spraying on the ingot edges of the ingot FIG. 9: Temperature profile with hot ingot edges, created by insufficient spraying on the ingot edges of the ingot FIG. 10 shows two spray width modes or strategies for a 600 mm thick and 1700 mm wide aluminium alloy ingot; on the left a thermal profile in the transverse direction with cold ingot edges and with 11 nozzles in action; on the right a thermal profile with hot ingot edges with 9 nozzles in action.

Figure 11:
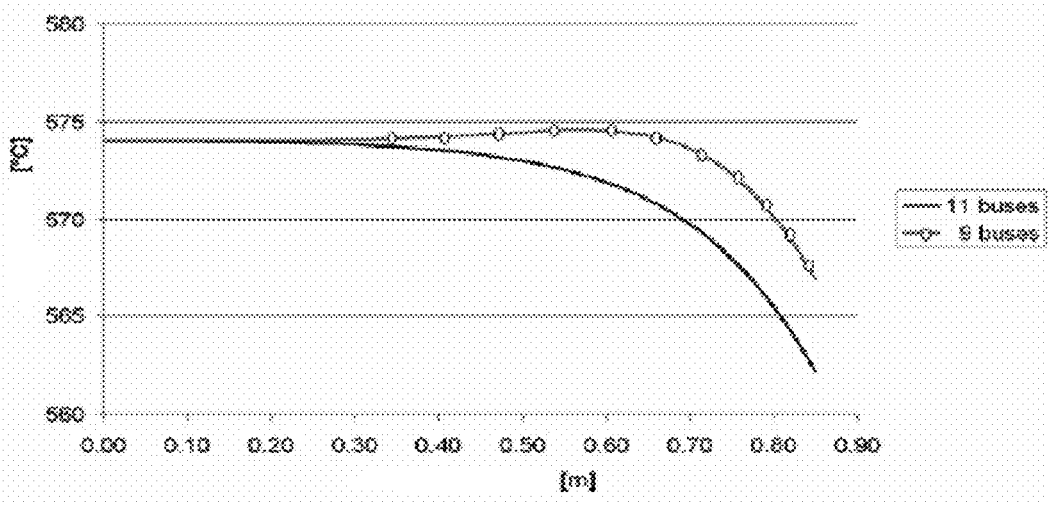

FIG. 11 is the effect on the thermal profile (temperature in ° C. as a function of position in the transverse direction, from the axis of the ingot in m) of these two spray modes.

Figure 12:
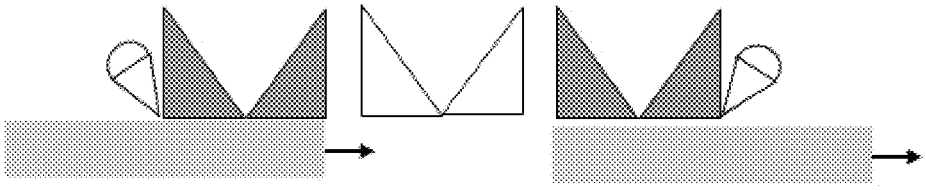
Figure 13:
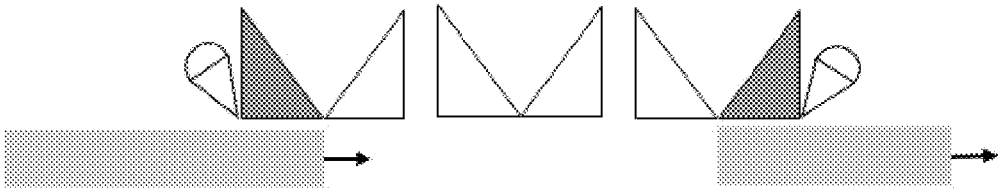
Figure 14:
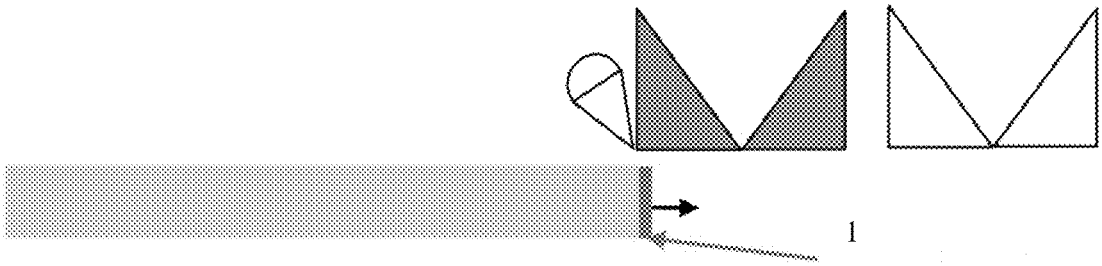

FIGS. 12 to 14 illustrate three examples of modes or strategies for triggering spraying.

The thermal profile in the longitudinal direction of the ingot is controlled by:

Absence of, or very low runoff in the longitudinal direction of the ingot, by mounting the upper ramps in opposition Starting and stopping spraying of each pair of ramps at a specific position of the ingot: this is the concept of a spraying heel.

FIG. 12 corresponds to management of the thermal profile in the longitudinal direction with hot ends, FIG. 13 with warm ends and FIG. 14 with cold ends (with runoff at 1).

Figure 15:
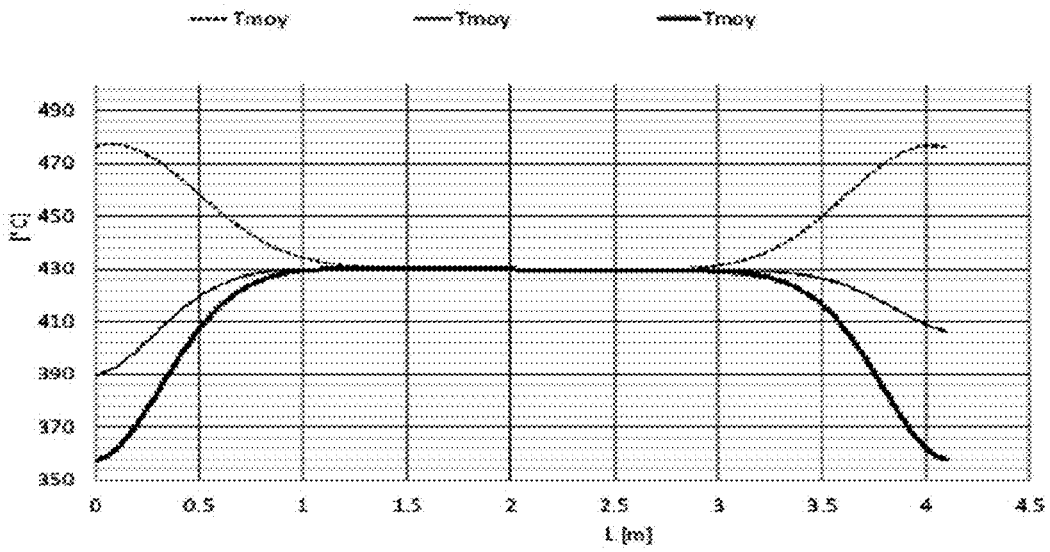

FIG. 15 illustrates the longitudinal thermal profile (temperature in ° C. as a function of the position in length L of the ingot in m) for the three aforementioned ingot end thermal management strategies. In this example, the ingot is made from AA6016 type alloy, 600 mm thick, average cooling is 100° C. in two passes, and the time spent in the thermal equalization chamber is 10 min.

Figure 16:
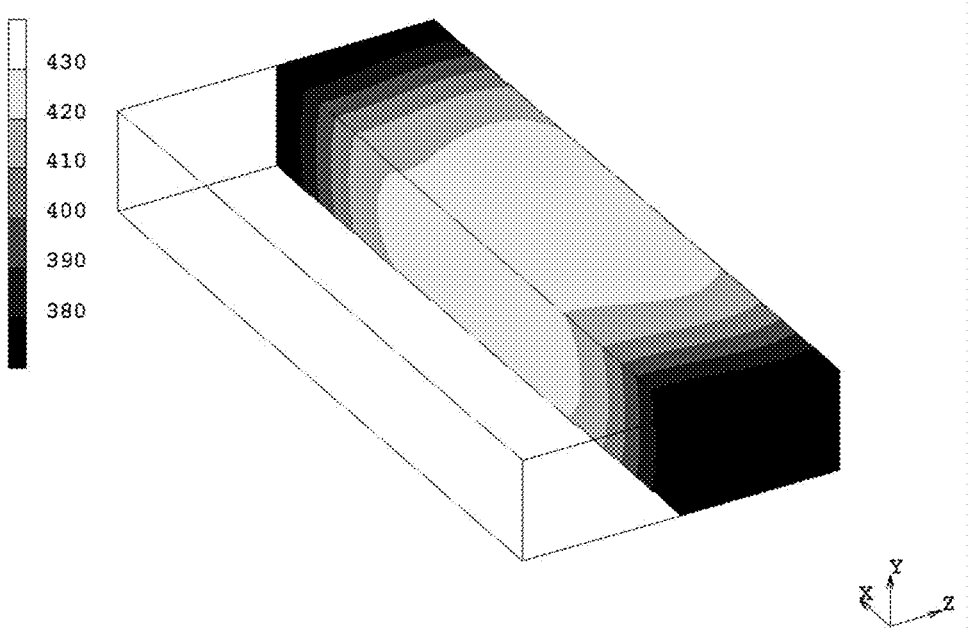
Figure 17:
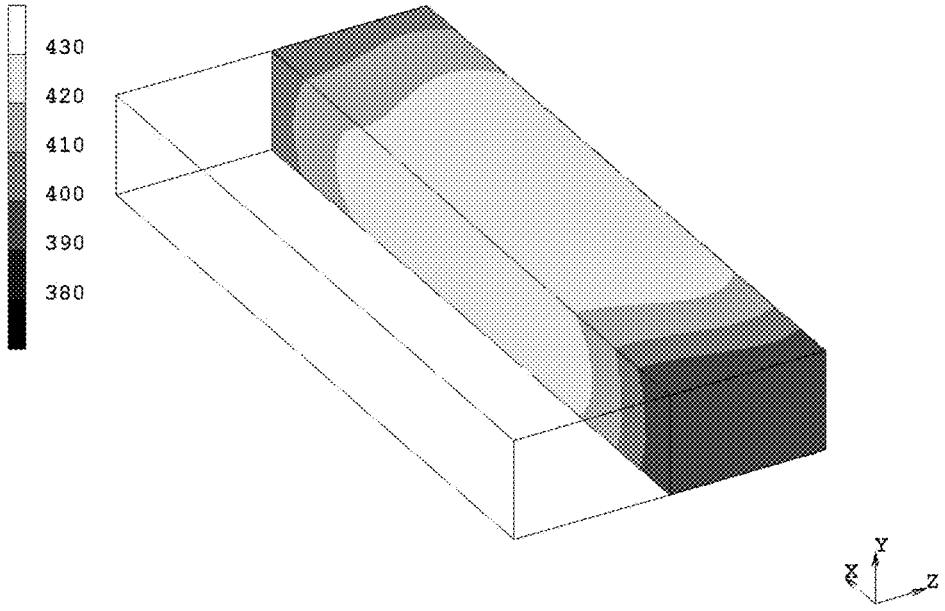
Figure 18:
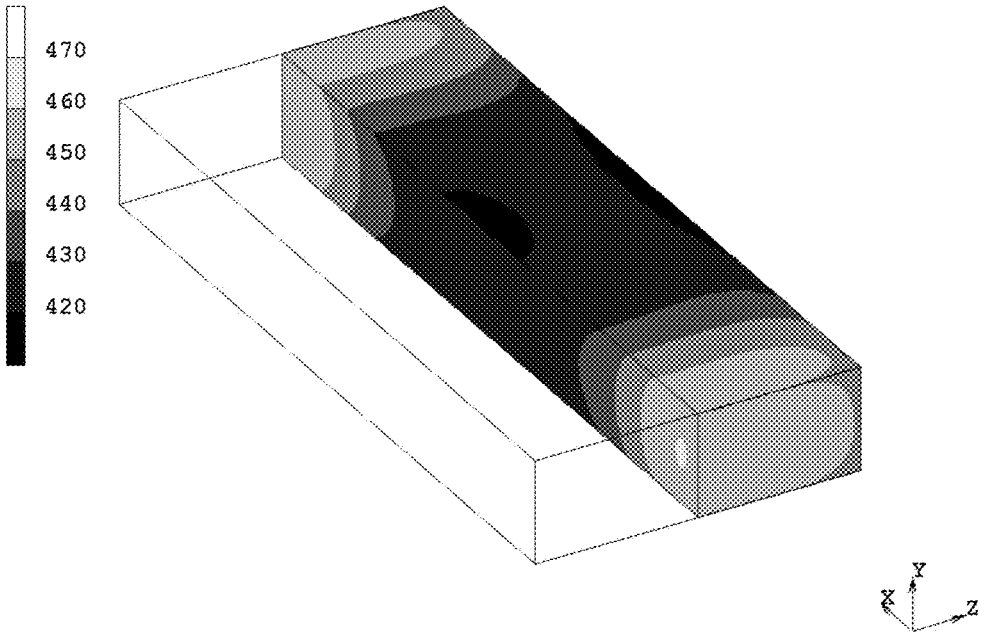

FIGS. 16 to 18 illustrate the thermal field, as a 3D display, of the same example, entering the hot rolling stage for the three aforementioned ingot end thermal management strategies, FIG. 16 with hot ends, FIG. 17 with warm ends and FIG. 18 with cold ends.

It can be seen that the spray triggering strategy clearly makes it possible to control the longitudinal thermal profile of the ingot.

Figure 19:
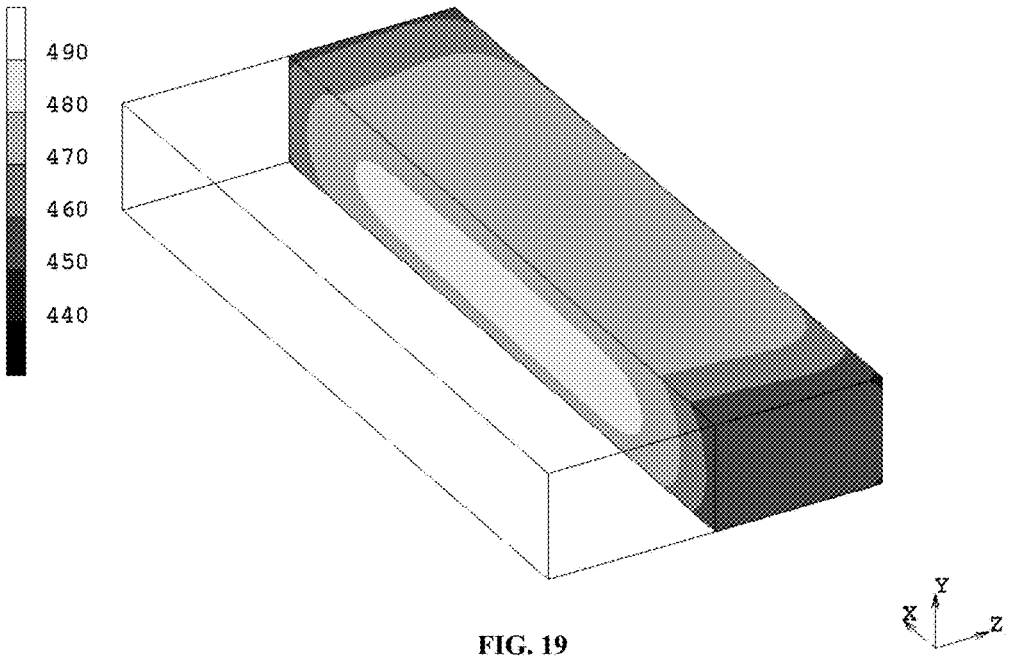

FIG. 19 shows the thermal field of an ingot made of AA6016 type alloy, 600 mm thick, cooled to about 50° C. in one pass in the spray machine set with a spraying heel of a single ramp at the ends of the ingot, as shown in FIG. 13. This setting gives a very uniform thermal field with slightly warmer ends, which is conducive to rolling.

DETAILED DESCRIPTION OF A PREFERRED EMBODIMENT

The invention essentially consists of a cooling process using a cooling liquid or spray for a slab or a rolling ingot made of aluminium alloy, of 30 to 150° C. in a few minutes, i.e. at an average cooling rate of between 150 and 500° C./hour.

It is principally made up of two phases:

A first phase in which the ingot is sprayed with a cooling liquid or spray, typically using continuous spraying A second phase of thermal equalization of the ingot.

During the first spraying phase, the ingot is cooled in a chamber having nozzles spraying cooling liquid or spray under pressure, typically water and preferably deionized.

The nozzles or tuyers are divided up in the upper and lower parts of said chamber, so as to spray the two large upper and lower surface of the ingot.

The option of a continuous spraying process can limit the risk of hot spots related to contacts between the ingot and its support, which generally consists of cylindrical or conical rollers.

The average cooling of the ingot (ΔTmoy ingot) is controlled by the spraying time for each section of the ingot.

During this phase, the ingot is thermally very heterogeneous in its thickness, because of the high Biot number.

The cooling homogeneity in the width of the ingot is controlled by:

a) Controlling the spray width in the transverse direction of the ingot, by the number of active nozzles or the use of screens b) A spray method promoting lateral discharge of the water sprayed on the upper surface. The cooling liquid is guided to the ingot edges of the ingot and is discharged in the form of a cascade without touching the small surfaces of said ingot. Because of this, ingot cooling is very homogeneous. This method in fact consists of pairing two ramps of nozzles, arranged in opposition, as shown in FIGS. 3 and 4.

The cooling homogeneity in the length of the ingot is controlled by:

c) Controlling the beginning and the end of spraying by triggering spraying ramps at the desired position on the ingot or, again, by the use of screens. In this way, it is possible for the head and the foot of the ingot not to be sprayed. An ingot is then obtained with a hot head and foot, which helps it to engage during reversible hot rolling d) Greatly reducing runoff in the longitudinal direction of the ingot. This very low runoff is achieved through characteristic b) above of the invention, favouring lateral discharge of the cooling liquid sprayed on top of the ingot.

The spray phase is therefore designed to reduce thermal heterogeneity in the three directions of the ingot. The invention particularly makes it possible to control the temperature profiles in the transverse direction and in the longitudinal direction of the ingot, which is very significant because possible thermal gradients along the two large dimensions would be difficult to reverse in a short time.

Then follows the phase of thermal equalization of the ingot:

After spraying, the ingot is kept for a few minutes in a configuration of low heat exchange with its environment. These thermal conditions allow thermal equalization of the ingot, in a few minutes for cooling by less than 30° C. and in about 30 minutes maximum for cooling by 150° C. This phase is essential to achieve the required thermal uniformity specifications. It enables a thermal differential of DTmax of less than 40° C. to be achieved on a large ingot.

The invention can also be adapted to high absolute cooling values. When the required mean cooling of the ingot is greater than typically 80° C., it is possible to cycle all the "spray" and "equalization" phases, reducing the average temperature of a very thick ingot at each "spray-equalization" cycle.

The method described ensures rapid and controlled cooling of a thick slab, in particular a rolling ingot, made of aluminium alloy. It is also robust and prevents the known risks of local excess cooling.

The cooling machine or facility, which itself comprises, firstly, at least one spray chamber, typically horizontal and spraying continuously, and, secondly, at least one thermal equalization tunnel.

The spray chamber allows phase 1 of the process described above to be implemented. The steps involved in processing the ingot in this machine or facility are:

1) Centring the ingot, at the entrance to the machine
2) Measuring the upper surface temperature of the ingot
3) Calculation by the PLC, using the thermal model, of the spray chamber settings depending on the input temperature and the target output temperature, i.e. target cooling of the ingot, including determining the number of ramps of nozzles activated, the number of nozzles open at the ingot edges, speed of movement of the ingot within the spray chamber, starting and stopping the spraying ramps, the holding time in the equalization tunnel
4) Moving the ingot through the spray chamber, with upper and lower spraying according to the PLC calculations.

The spray chamber is provided with ramps of nozzles or tuyers for spraying cooling liquid or spray under pressure.

If the latter is water, it should ideally be deionized or at least very clean and with a very low mineral content, to prevent clogging the nozzles and to ensure stability of heat transfer between the water and the ingot. The spraying machine can advantageously, particularly for reasons of economy, operate in a closed cycle, for example with a catch basin under the spraying machine.

The cooling liquid or spray nozzles produce full cone sprays or jets with an angle of between 45 and 60° (in the example: 60° angle full cone nozzles of the Lechler brand). The nozzle axes of the lower ramps are oriented normally to the lower surface. The upper ramps are paired. In any given pair of upper ramps, the ramps are inclined such that:

- The jets of the two ramps are oriented in opposition to one another
- The jets have a normal edge to the upper surface of the ingot
- The overlap of two jets is between ⅓ and ⅔ of the width of the jet, and preferably substantially half
- The envelope of the two jets so formed has an M profile.
- The pairs of upper and lower nozzle ramps are placed substantially face-to-face, so that the upper and lower spray lengths are substantially equal and opposite each other.

In the case of continuous spraying, the ingot travel speed is greater than, or equal to 20 mm/s, or 1.2 m/min.

On leaving the spray chamber, the ingot is transferred, for example using automated carriages, into one or more equalization tunnel(s). The purpose of the tunnel is to minimize heat transfer between the ingot and air, which helps to achieve better thermal equalization of the ingot. This thermal equalization occurs by diffusion of heat in the ingot, the core warming the surfaces of the ingot.

The equalization tunnel consists of vertical walls and a roof made from a materially that is ideally reflective on the inner side of the tunnel.

It prevents air currents around the ingot, ensuring the absence of heat transfer by forced convection. It also reduces heat transfer by natural convection and limits radiative transfer if the walls are reflective.

Finally, the cooling machine or facility comprising the spray chamber and the equalization tunnel is controlled by a thermal model encoded in the PLC of the machine. The thermal model determines the settings of the machine depending on the temperature at the start of the spray chamber, or input temperature, and depending on the target output temperature, usually the rolling temperature.

EXAMPLES

Example 1: Uniform Cooling by 40° C. of an AA3104 Type Alloy Ingot

FIG. 5 shows cooling by 40° C. of an AA3104 type alloy according to designations defined by the "Aluminum Association" in the "Registration Record Series" that it publishes regularly. The ingot is 600 mm thick, 1850 mm wide and 4100 mm long.

The ingot leaves the homogenizing furnace at 600° C.

Figure 1:
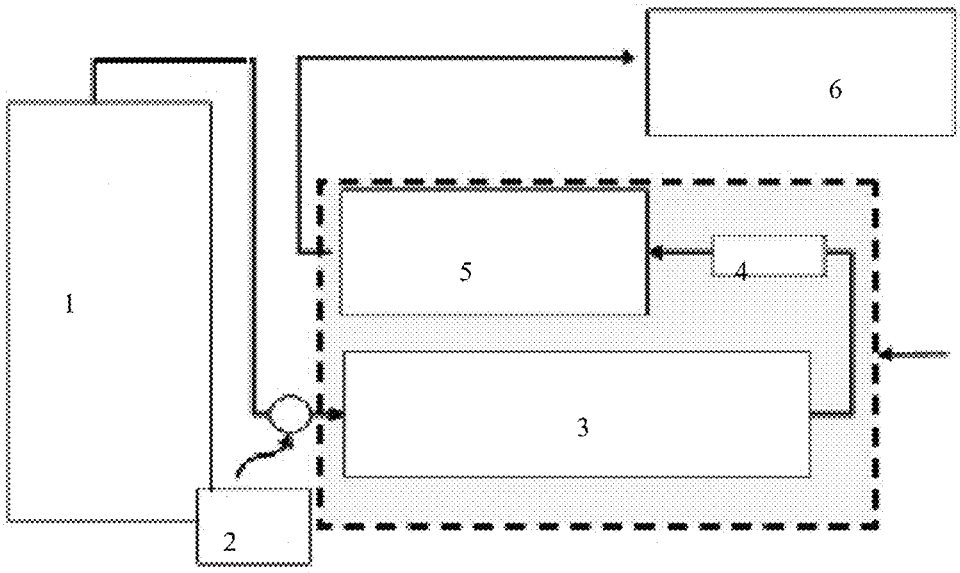
FIG. 1 shows a schematic diagram of the method according to the invention in one pass. The ingot is removed from the homogenization furnace 1 at its homogenization temperature. It is transferred to the cooling machine, laterally centred and its surface temperature is measured (2) by surface thermocouple, by contact or with an infrared pyrometer, which will be less accurate. The thermal model determines the spray chamber setting 3 (number of pairs of activated ramps and ingot speed). Then the ingot is treated in the spray chamber. When it leaves, it is dry and is transferred (4) to an equalization tunnel 5 for a period determined by the thermal model or depending on the amplitude of cooling undergone. At the end, it is transferred to the hot rolling mill 6.

The ingot cooling method is the single-pass method described in FIG. 1.

The ingot is transferred to the cooling machine in 180 s. This transfer time includes:

- moving the ingot between the furnace outlet and the inlet of the cooling machine
- lateral centring of the ingot
- measuring the upper surface temperature of the ingot
- The calculation time of the cooling machine settings by the PLC (spray chamber and tunnel).

Then the ingot moves through the spray chamber, each point of the ingot except the ends (head and foot) undergoing spraying for 46 seconds. The surface flow rate of the spray is 5001/(min·m$^2$) on the two large surfaces of the ingot. The spray heel is set to a pair of ramps, as described in FIG. 12. On leaving the spray chamber, the ingot is dry and is transferred in 30 s to an equalization tunnel for a period determined by the thermal model encoded in the PLC, here 300 s, or 5 minutes. At the end, the ingot is transferred to the hot rolling mill with a temperature uniformity better than 40° C. over the complete ingot.

The ingot surface temperature drops to about 320° C., while the core of the ingot remains almost isothermal during the spraying phase. Then, by heat diffusion between the core and the surface, the core gives up heat to the surface, and the ingot becomes thermally uniform.

The thermal differential in the ingot (dt max) is maximal at the end of the spray phase; its value is approximately 280° C. for this configuration. It drops quickly once spraying of the ingot stops: after a 6 minute wait (transfer and equalization in the tunnel), the thermal differential DTmax is reduced to less than 40° C.

Example 2: Uniform Cooling by 135° C. of an AA6016 Type Alloy Ingot

FIG. 6 shows uniform cooling by 135° C. of an AA6016 type alloy ingot. The ingot is 600 mm thick, 1850 mm wide and 4100 mm long. The ingot leaves the homogenizing furnace at 530° C.

Figure 2:
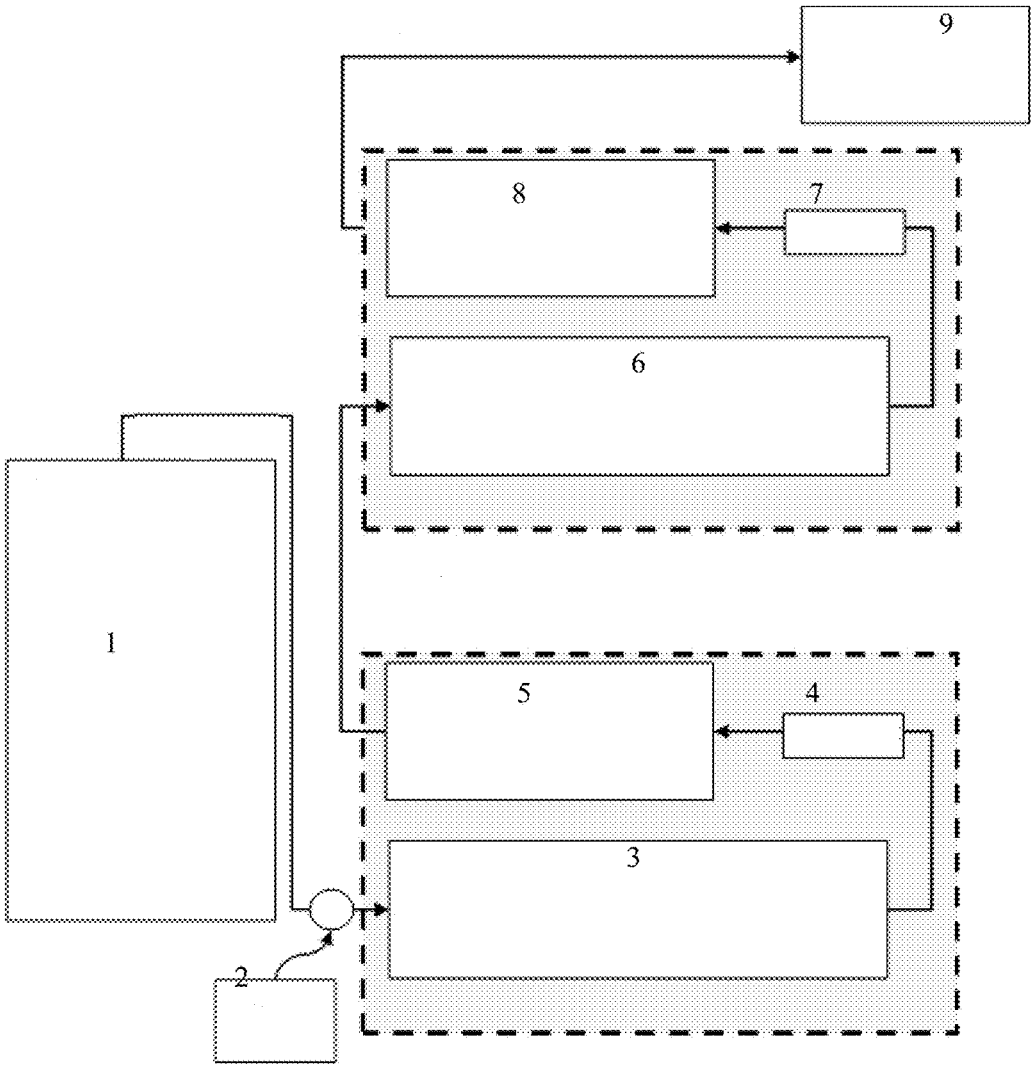
FIG. 2 shows a schematic diagram of the method according to the invention in two passes or more. When the cooling target amplitude is greater than 100° C., a single pass through the cooling machine may be insufficient. In this case, the ingot is cooled for the first time in the first spray chamber 3. Then, with or without passing through the intermediate equalization tunnel 5, the ingot is transferred to the second cooling machine composed of elements 6, 7 and 8, where it undergoes a complete cycle: spray chamber and then, obligatorily, the equalization tunnel 8. The duration of the final phase of equalization depends on the thermal diffusivity of the material, and therefore the alloy, the target cooling amplitude, and the severity of the target thermal uniformity before hot rolling 9.

The ingot cooling method is the two-pass method described in FIG. 2.

The ingot is transferred to the cooling machine in 100 s. This transfer time includes:

- moving the ingot between the furnace outlet and the inlet of the cooling machine
- lateral centring of the ingot
- measuring the upper surface temperature of the ingot
- the calculation time of the cooling machine settings by the PLC. Then the ingot moves through the spray chamber, each point of the ingot except the ends (head and foot) undergoing spraying for 51 seconds. The surface flow rate of the spray is 800 l/(min·m$^2$) on the two large surfaces of the ingot. The spray heel is set to one ramp, as described in FIG. 13. On leaving the spray chamber, the ingot is transferred in 60 seconds to the second spray chamber without, in this example, passing through the optional intermediate equalization tunnel. The ingot then undergoes a second spraying, identical to the first: each point of the ingot except for the ends undergoes spraying for 51 seconds, at a surface flow rate of 800 l/(min·m$^2$). On leaving the second spray chamber, the ingot is transferred to the equalization tunnel in 30 seconds. The ingot waits for several minutes in the equalization tunnel. At the end, the ingot is transferred to the hot rolling mill with a temperature uniformity better than 40° C. over the complete ingot.

The ingot surface temperature drops to about 60° C. The core of the ingot remains almost isothermal during the first spray phase and then cools during the second spray phase. Then, by heat diffusion between the core and the surface, the core gives up heat to the surface, and the ingot becomes thermally uniform.

The thermal differential in the ingot (Dt max) is maximal at the end of each of the spray phases, its value is approximately 470° C. for this configuration. It drops quickly once spraying of the ingot stops: the thermal differential DTmax of the ingot is 55° C. after a 13 minute wait in the tunnel and falls to below 40° C. after 23 minutes in the tunnel.

Example 3: Uniform Cooling by 125° C. of an AA6016 Type Alloy Ingot

The ingot is 600 mm thick, 1850 mm wide and 4100 mm long. The ingot leaves the homogenizing furnace at 530° C.

The ingot cooling method is the two-pass method described in FIG. 2.

The ingot is transferred to the cooling machine in 100 s. This transfer time includes:

- moving the ingot between the furnace outlet and the inlet of the cooling machine
- lateral centring of the ingot
- measuring the upper surface temperature of the ingot
- the calculation time of the cooling machine settings by the PLC. Then the ingot moves through the spray chamber, each point of the ingot undergoing spraying for 51 seconds. The surface flow rate of the spray is 500 l/(min·m$^2$) on the two large surfaces of the ingot. The spray heel is zero, as described in FIG. 14. The ingot is therefore completely sprayed in an identical manner, which generates a longitudinal thermal profile with cold ends. On leaving the spray chamber, the ingot is transferred in 60 seconds to the second spray chamber without, in this example, passing through the optional intermediate equalization tunnel. The ingot then undergoes a second spraying, different from the first. The ingot, but this time not including the ends, undergoes a second spraying for 51 seconds at a surface flow rate of 500 l/(min·m$^2$). The spray heel is a pair of ramps, as described in FIG. 12. This setting tends to straighten the cold end thermal profile, generating an almost flat longitudinal thermal profile on leaving the second spray chamber. On leaving the second spray chamber, the ingot is transferred to the equalization tunnel in 30 seconds. The ingot waits for only 10 minutes in the equalization tunnel. At the end, the ingot is transferred to the hot rolling mill with a temperature uniformity better than 40° C. over the complete ingot.

Example 3 shows that a judicious choice of spraying heels can significantly reduce equalization time after spraying. For a cooling method in several passes, the choice of heels may differ from one pass to another. For a cooling method in 2 passes, the heel chosen for the first pass gains from being contrary to the heel chosen for the second pass. In an optimized manner, and for a cooling method in 2 passes, a first pass with zero heel (continuous spraying of the ingot) followed by a second pass with a heel of a pair of ramps can significantly reduce the equalization time required for thermal balancing of the ingot.

The invention claimed is:

1. A method of cooling an aluminum alloy rolling ingot after a metallurgical homogenization heat treatment of said ingot at a homogenization temperature, optionally between 450 to 600° C., and prior to hot rolling, wherein the aluminum alloy rolling ingot has a format of dimensions from 250 to 800 mm in thickness, from 1000 to 2000 mm in width, and from 2000 to 8000 mm in length; a top surface, a bottom surface, and four side surfaces, wherein the top and bottom surfaces have a larger surface area than the side surfaces; and a head and a foot corresponding to extremities in a longitudinal direction, wherein cooling, by a cooling value of 30 to 150° C., is performed at a rate of from 150 to 500° C./h, with a thermal differential of less than 40° C. over the entire ingot cooled from the homogenization temperature thereof, and wherein cooling is carried out in at least two phases:

a first spraying phase in which the ingot is cooled in a chamber equipped with a spray system comprising ramps of nozzles for spraying cooling liquid or spray under pressure, divided into upper and lower parts of said chamber, so as to spray the larger top and bottom surfaces of said ingot, and a complementary phase of thermal equalization in still air, in a tunnel with interior reflective walls, lasting from about 2 to about 30 minutes, depending on the format of the ingot and the cooling value; and wherein the spray system guides the cooling liquid or spray under pressure to the ingot edges where the cooling liquid or spray under pressure is discharged in form of a cascade without touching the ingot's small side surfaces.

2. The method according to claim 1, wherein the spraying and thermal equalization phases are repeated and for an overall average cooling of more than 80° C.

3. The method according to claim 1, wherein the cooling liquid or spray under pressure is water.

4. The method according to claim 1, wherein the head and the foot of the ingot are cooled less than the rest of the ingot.

5. The method according to claim 1, wherein cooling of the head and foot is modulated by turning the ramps of nozzles on or off.

6. The method according to claim 4, wherein the cooling of the head and foot is modulated by a presence of screens.

7. The method according to claim 1, wherein the spraying phase and not thermal equalization is repeated, and in that the head and foot of the ingot are cooled differently from the rest of the ingot in the chamber.

8. The method according to claim 7, wherein a first spray pass is performed with zero heel, or continuous spraying of the ingot is followed, without a first thermal equalization phase, by a second spray pass with a heel of a pair of ramps, thereby allowing to reduce the duration of a final equalization phase necessary for thermal balancing of the ingot.

9. The method according to claim 1, wherein longitudinal thermal uniformity of the ingot is improved by relative movement of the ingot in relation to the spray system: the ingot passes or moves with a reciprocating movement facing a fixed spray system or vice versa.

10. The method according to claim 9, wherein the ingot moves horizontally in the chamber at a speed greater than or equal to 20 mm/s, or 1.2 m/min.

11. The method according to claim 1, wherein transverse thermal uniformity of the ingot is ensured by modulating spraying in the ingot width by switching the nozzles on or off, or screening said spraying.

12. The method according to claim 1, wherein the nozzles produce full cone jets with an angle of between 45 and 60°, and lower nozzle axes are oriented normally to the bottom surface of the ingot.

* * * * *